United States Patent [19]

Snyder

[11] 4,295,702

[45] Oct. 20, 1981

[54] MULTI-OUTLET ADAPTER FOR PLUG-IN TELEPHONES

[75] Inventor: Dennis R. Snyder, Des Moines, Iowa

[73] Assignee: Bell Telephone Laboratories, Incorporated, Murray Hill, N.J.

[21] Appl. No.: 105,900

[22] Filed: Dec. 21, 1979

Related U.S. Application Data

[63] Continuation of Ser. No. 912,467, Jun. 5, 1978, abandoned, which is a continuation of Ser. No. 714,525, Aug. 16, 1976, Pat. No. T958,009.

[51] Int. Cl.[3] ..... H01R 13/514

[52] U.S. Cl. ..... 339/97 P; 339/154 R; 179/1 PC

[58] Field of Search ..... 339/91 R, 97 P, 98, 339/99 R, 153, 154 R, 154 A; 179/1 PC

[56] References Cited

U.S. PATENT DOCUMENTS

| | | | |
|---|---|---|---|
| 1,983,725 | 12/1934 | Abramson | 339/28 |
| 3,761,869 | 9/1973 | Hardesty et al. | 339/99 R |
| 3,824,530 | 7/1974 | Roberts et al. | 339/99 R |
| 3,850,497 | 11/1974 | Krumreich et al. | 339/126 R |
| 3,860,316 | 1/1975 | Hardesty | 339/91 R |
| 3,990,764 | 11/1976 | Krumreich | 339/176 M |
| 4,025,141 | 5/1977 | Thelissen | 339/99 R |

*Primary Examiner*—Eugene F. Desmond

*Attorney, Agent, or Firm*—Harry L. Newman

[57] ABSTRACT

An adapter in accordance with the present invention comprises a male member joined to a female member. The male member includes a plug portion having a plurality of spaced slots into which a plurality of blade contacts are respectively inserted, the blade contacts making electrical connection with conductors positioned within troughs that respectively communicate with the slots. Each conductor is doubled over within its associated trough, and both ends of each conductor are terminated with a wire spring contact. The contacts at one end of these conductors are mounted in a first contact carrier, while the contacts at the other end are mounted in a second contact carrier. In addition, a plurality of conductors, also terminated at both ends with the wire spring contacts, extend directly between the carriers.

The contact carriers are respectively accommodated within a pair of internally communicating openings in the female member in such a manner that the wire spring contacts are exposed within a pair of externally communicating jack openings of the female member. Each externally communicating jack opening is adapted to accommodate a plug having contacts arranged so as to engage the contacts of the associated carrier and thereby be electrically connected to the blade contacts in the plug portion and the contacts of the other carrier.

7 Claims, 6 Drawing Figures

MULTI-OUTLET ADAPTER FOR PLUG-IN TELEPHONES

CROSS REFERENCE TO RELATED APPLICATIONS

This application is a continuation of my pending application, Ser. No. 912,467, filed June 5, 1978, now abandoned which is a continuation of my application Ser. No. 714,525, filed Aug. 16, 1976, and now Defensive Publication T958,009, published May 3, 1977.

TECHNICAL FIELD

This invention relates to the field of connectors and within that field to an adapter for providing multiple jack access at a single jack location.

BACKGROUND OF THE INVENTION

The wall jack provided by telephone companies provides a single outlet for connecting telephone station equipment, such as a telephone set, to an associated telephone line. However, there are some situations where it is desirable to be able to connect two pieces of telephone station equipment to the telephone line in parallel at the same location. Thus for example, a telephone answering device is typically connected in parallel with an adjacent telephone set. There are other situations where it is desirable to be able to connect an external signal source or an auxiliary power supply to telephone station equipment at the same location and/or on the same premises, such as to provide power to an incandescent lamp mounted within a telephone set for illuminating the dial. There are still other situations where it is desirable to be able to rearrange the location of the contacts to which the tip and ring line conductors and/or power or other signal leads are connected. There is therefore a need for an adapter to provide multiple jack access at a single jack location.

SUMMARY OF THE INVENTION

An adapter in accordance with the present invention has a T configuration with a plug portion forming the stem of the T and a pair of adjacent jack portions facing opposite to the plug portion forming the crossbar of the T. Each contact of the plug portion is electrically connected to a contact of each jack portion by a single conductor. The conductor is doubled over within a conductor receiving trough in the plug portion wherein it is pierced by the associated plug contact.

The ends of each conductor are joined to wire springs that are respectively mounted in each jack portion and serve as contacts of the jack portion. Thus the wire spring contacts of each conductor are connected in parallel to the associated plug contact in the plug portion. The conductive paths thereby provided can be used to connect two pieces of station equipment to the same wall jack. They can also be used to apply an auxiliary power source or external signal source to (1) station equipment connected to the other jack portion of the adapter, and (2) via the premise wiring to station equipment at other locations on the premises.

Other wire spring contact terminated conductors extend directly between selected positions of the two jack portions. The wire spring contacts terminating these conductors are therefore connected in series, and conductive paths that bypass the plug portion are provided that can be used to apply an external signal source or an external power source only to station equipment connected to the other jack portion.

The wire spring contacts mounted to the ends of each conductor may be mounted in each jack portion in positions that correspond to the position of the associated contact in the plug portion. However, the wire spring contacts may also be mounted in different positions relative to the associated plug contact so as to rearrange the locations at which power or signals may be obtained.

DETAILED DESCRIPTION

Figure 1:
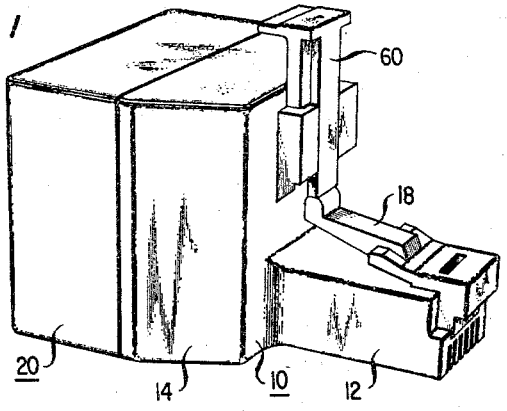
FIG. 1 is a perspective view of the adapter showing the plug portion thereof.
Figure 2:
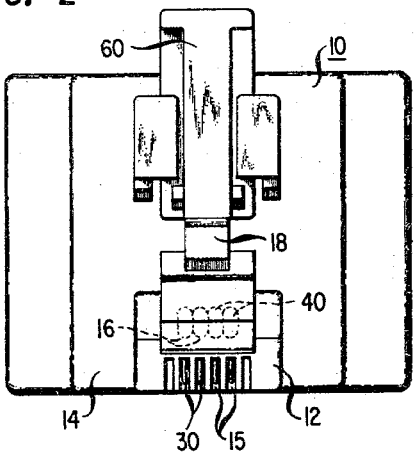
FIG. 2 is an end view looking toward the plug portion of the adapter.
Figure 3:
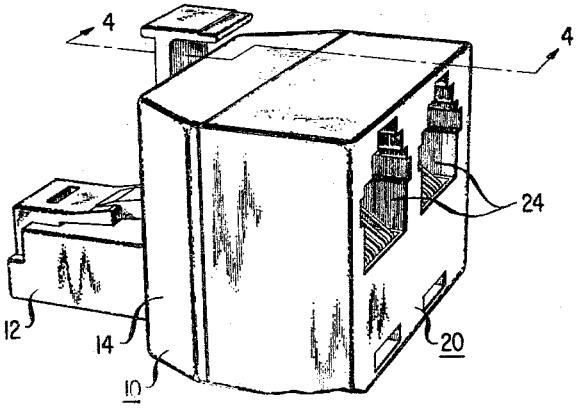
FIG. 3 is a perspective view showing the jack portions of the adapter.

Referring to FIGS. 1 and 3 of the drawing, the adapter includes a male member 10 joined to a female member 20. The male member 10 comprises a plug portion 12 that is integral with and extends from a housing portion 14. As seen most clearly in FIGS. 2 and 4, the plug portion 12 is similar to the plug disclosed in Hardesty U.S. Pat. No. 3,860,316 issued Jan. 14, 1975 in that it includes a plurality of spaced slots 15 into which a plurality of blade contacts 30 are respectively inserted, the blade contacts having tangs 32 that pierce through the insulation of and make electrical connection with conductors 40 positioned within troughs 16 that respectively communicate with the slots.

Figure 4:
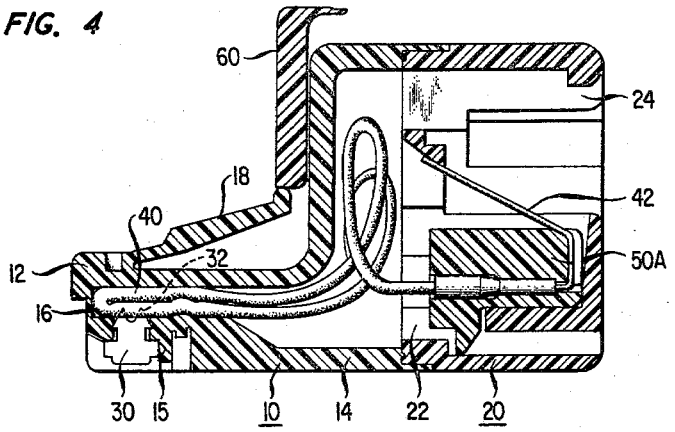
FIG. 4 is a cross-sectional view taken along line 4—4 of FIG. 3.
Figure 5:
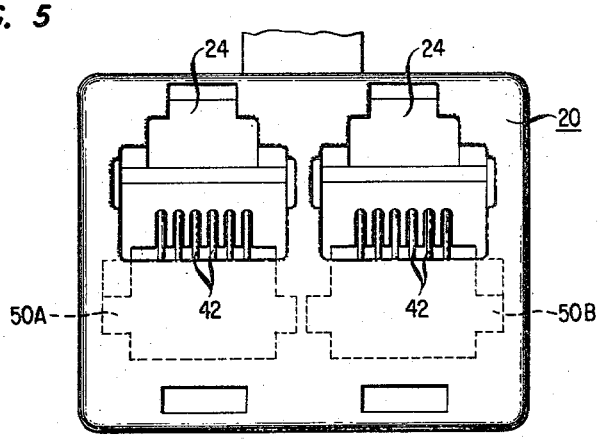
FIG. 5 is an end view looking toward the jack portion of the adapter.
Figure 6:
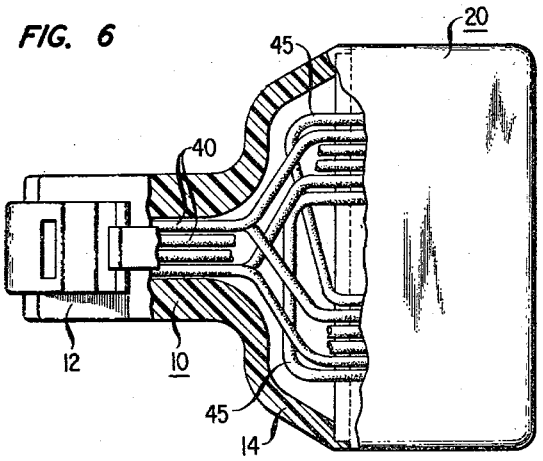
FIG. 6 is a top view with portions broken away showing one interconnection arrangement between the plug portion and the jack portions.

Referring now to FIGS. 4, 5, and 6, each conductor 40 is doubled over within its associated trough 16, and both ends of each conductor are terminated with a wire spring contact 42 in the manner disclosed in FIG. 4 of Krumreich et al U.S. Pat. No. 3,850,497 issued Nov. 26, 1974. The contacts 42 at one end of the conductors 40 are mounted in a first contact carrier 50A, while the contacts at the other end of the conductors are mounted in a second contact carrier 50B. In addition, as shown in FIG. 6, two conductors 45, which are also terminated at both ends with wire spring contacts 42, extend directly between the contact carriers 50A and 50B.

The contact carriers 50A and 50B are identical and, as seen most clearly in FIG. 4, they are of the type disclosed in patent application Ser. No. 648,280 filed Jan. 12, 1976 and now U.S. Pat. No. 3,990,764. Each contact carrier 50A and 50B is accommodated within the female member 20 in an internally communicating opening 22 of the type and in the manner disclosed in the copending application whereby the contacts 42 are exposed within an externally communicating jack opening 24 in the female member. The internally communicating openings 22 and thereby externally communicating jack openings 24 are side-by-side one another, and the externally jack communicating openings are adapted to accommodate plugs having contacts arranged so as to engage the contacts 42. The contacts of the plugs are thereby electically connected to the blade contacts 30 in the plug portion 12 and to the contacts 42 of the other contact carrier 50.

Referring again to FIG. 1, the plug portion 12 includes a latch 18 that serves to secure the plug portion and thereby the adapter to a complementary jack in the manner disclosed in FIG. 1 of the Hardesty et al U.S. Pat. No. 3,761,869 issued Sept. 25, 1973. A snap-in plunger 60 slidably mounted to the exterior of the housing portion 14 extends above the housing portion and is actuated to depress the latch 18 to release the plug portion from the associated jack.

Although a specific embodiment of the invention has been shown and described, it will be understood that it is but illustrative and that various modifications may be made herein without departing from the scope and spirit of this invention as defined in the appended claims.

I claim:

1. A multi-outlet adapter for plug-in telephones comprising:

a male member including a plug portion having a plurality of troughs respectively communicating with a like plurality of slots in the plug portion;

a plurality of conductors totally contained within the adapter, each conductor being doubled over within an individual trough in the plug portion and both ends of each conductor being terminated with a wire spring jack contact;

a plurality of blade-like plug contacts respectively positioned within the slots in the plug portion, each plug contact making electrical connection with the conductor positioned in the associated trough whereby the jack contacts terminating the ends of the conductor are connected in parallel to the associated plug contact;

a pair of contact carriers, each contact carrier having one of the jack contacts mounted therein; and a female member joined to the male member, the female member having a pair of jack openings open to the outside of the adapter, the female member also having means for accommodating an individual carrier adjacent to each of the jack openings such that the jack contacts mounted in the carriers are exposed within the jack openings.

2. An adapter as in claim 1 wherein each conductor is electrically connected to contacts having corresponding positions in the plug portion and the jack openings.

3. An adapter as in claims 1 or 2 further including at least one conductor that extends directly between the two contact carriers and is not electrically connected to the plug portion, the ends of the conductor being terminated with jack contacts that are respectively mounted in the carriers.

4. A multi-outlet adapter for plug-in telephones comprising:

a male member including a plug portion;

a plurality of conductors totally contained within the adapter, each conductor being doubled over within the plug portion and both ends of each conductor being terminated with a jack contact;

a plurality of plug contacts mounted in the plug portion, each plug contact making electrical connection with an individual conductor in the plug portion whereby the jack contacts terminating the ends of the conductor are connected in parallel with the associated plug contact;

a female member joined to the male member, the female member having a pair of jack openings open to the outside of the adapter; and means for mounting one jack contact terminating each conductor so as to be exposed within one of the jack openings and mounting the other jack contact terminating each conductor so as to be exposed within the other of the jack openings.

5. An adapter as in claim 4 further including at least one conductor that extends directly between the two jack openings and is not electrically connected to the plug portion, the ends of the conductor being terminated with jack contacts, and the mounting means mounting the jack contacts so that one is exposed within one of the jack openings and the other is exposed within the other of the jack openings.

6. A multi-outlet adapter for plug-in telephones comprising:

a male member including a plug portion;

a plurality of conductors totally contained by the adapter, each conductor being doubled over at the plug portion, and each conductor having a jack contact at each end;

a female member joined to the male member, the female member having a pair of jack openings open to the outside of the adapter; and means for mounting one jack contact of each conductor so as to be exposed within one of the jack openings and for mounting the other jack contact of each conductor so as to be exposed within the other of the jack openings.

7. A multi-outlet adapter for plug-in telephones comprising:

a dielectric housing having a plug portion at one end and a jack portion at the other end, the jack portion having a pair of jack openings open to the outside of the housing;

a plurality of conductors totally contained by the housing, each conductor being doubled over at the plug portion, and each conductor having a jack contact at each end; and means for mounting one jack contact of each conductor so as to be exposed within one of the jack openings and for mounting the other jack contact of each conductor so as to be exposed within the other of the jack openings.

* * * * *